US010021998B2

(12) United States Patent
Gates et al.

(10) Patent No.: US 10,021,998 B2
(45) Date of Patent: Jul. 17, 2018

(54) PICTURE MOUNTING APPARATUS, SYSTEM AND METHOD

(71) Applicants: Rosse C. Gates, East Hampton, CT (US); Gazment Sosoli, Waterbury, CT (US); Caleb Gates, East Hampton, CT (US)

(72) Inventors: Rosse C. Gates, East Hampton, CT (US); Gazment Sosoli, Waterbury, CT (US); Caleb Gates, East Hampton, CT (US)

(73) Assignee: Eleframes, LLC, East Hampton, CT (US)

( * ) Notice: Subject to any disclaimer, the term of this patent is extended or adjusted under 35 U.S.C. 154(b) by 0 days.

(21) Appl. No.: 15/186,929

(22) Filed: Jun. 20, 2016

(65) Prior Publication Data

US 2017/0007044 A1 Jan. 12, 2017

Related U.S. Application Data

(60) Provisional application No. 62/188,793, filed on Jul. 6, 2015.

(51) Int. Cl.
*A47G 1/06* (2006.01)

(52) U.S. Cl.
CPC ..... *A47G 1/065* (2013.01); *A47G 1/0638* (2013.01); *A47G 2001/0666* (2013.01)

(58) Field of Classification Search
CPC ..... A47G 1/065; A47G 2001/0666
See application file for complete search history.

(56) References Cited

U.S. PATENT DOCUMENTS 1,210,215 A * 12/1916 Satterlee ..... G03B 21/64 40/710
1,435,762 A * 11/1922 Tomsich ..... G03B 21/64 40/777

(Continued)

*Primary Examiner* — Gary C Hoge
(74) *Attorney, Agent, or Firm* — UConn IP Law Clinic; Valeriya Svyston

(57) ABSTRACT

A picture mounting apparatus comprising: a frame member, the frame member comprising: a frame front surface; a frame rear surface located on a side opposite of the frame front surface; at least one connection area located on the frame member; a connector configured to removably attach to the at least one connection area, the connector comprising: a connector front surface; a connector rear surface on a side opposite of the connector front surface; a first tab located on the connector; a second tab located on the connector; a curved slit located between the first tab and the second tab; and where the connection area is configured to removably hold one corner of a photograph. A method of mounting a picture with a picture mounting apparatus comprising inserting a connector into a connection area of a frame member, fastening a second side of an adhesive to a mounting surface, and inserting a corner of a picture into the connection area of the frame member. A method of displaying a picture comprising attaching a picture mounting apparatus to a wall with an adhesive and inserting a picture into at least one connection areas of a frame member. A connector configured to selectively attach to at least one connection area comprising a connector front surface, a connector rear surface on a side opposite of the connector front surface, a first tab located on the connector, a curved slit located between the first tab and the second tab, and the connection area comprising and opening.

9 Claims, 12 Drawing Sheets

(56) References Cited

U.S. PATENT DOCUMENTS

| | | | | | |
|---|---|---|---|---|---|
| 4,017,989 | A * | 4/1977 | Murray | A47G 1/065 | 40/605 |
| 4,043,477 | A * | 8/1977 | Deese | G09F 5/00 | 206/0.83 |
| 4,115,938 | A * | 9/1978 | Belmuth | A47G 1/065 | 40/730 |
| 4,244,127 | A | 1/1981 | Buzzard | | |
| 4,510,707 | A * | 4/1985 | Girard | A47G 1/065 | 40/27.5 |
| 4,608,770 | A | 9/1986 | Gray | | |
| 4,912,863 | A * | 4/1990 | Harvey | A47G 1/065 | 40/730 |
| 5,075,991 | A * | 12/1991 | Wenkman | A47G 1/06 | 40/597 |
| 5,588,240 | A | 12/1996 | Zilliox | | |
| 6,101,752 | A * | 8/2000 | Cumberland | B42F 5/06 | 40/773 |
| 6,385,886 | B1 | 5/2002 | Chepikian | | |
| 6,460,280 | B1 * | 10/2002 | Haines-Woon | A47G 1/06 | 40/768 |
| 6,524,108 | B2 | 2/2003 | Murray | | |
| 6,705,034 | B1 | 3/2004 | Cahill | | |
| 7,100,317 | B1 * | 9/2006 | Strong | A47G 1/141 | 40/124.07 |
| 2004/0016164 | A1 | 1/2004 | Gilchrist et al. | | |
| 2006/0201039 | A1 * | 9/2006 | Gilliland | A47G 1/065 | 40/605 |
| 2009/0013577 | A1 * | 1/2009 | Barnard | A47G 1/065 | 40/731 |
| 2016/0345754 | A1 * | 12/2016 | Hogrefe | A47G 1/065 | |

* cited by examiner

PICTURE MOUNTING APPARATUS, SYSTEM AND METHOD

FIELD OF THE INVENTION

The invention relates to mounting and displaying pictures.

BACKGROUND OF THE INVENTION

Displaying images is well known, diverse and ever changing. Throughout time carvings, charcoal, chalk, dyes, ink, oils, and colored tiles were used as implements for capturing and displaying images on mediums such as rocks, stone tablets, woods, hides, canvases, parchments, and papers. Imagery included renditions of historical events, rules, portraits, maps, astrological observations, and maps.

In the more modern era, the advent of cameras led to photographs as a common medium for capturing and displaying images. Generally, images are captured by a camera, developed on paper-based materials into photographs and mounted in frames for display. More recently, the arrival of digital technology introduced a new channel for displaying pictures on display devices such as electronic visual displays.

Regardless of the display method, pictures have established themselves as a common source of decoration and means of social communication. While the options for displaying pictures have continuously expanded over time the traditional practice of physically mounting pictures remains desirable. Recent trends include mounting and displaying many pictures together to create collages, storyboards, and collections. In homes people may place pictures in wood, metal, glass, plastic, composite or other custom ridged material frames designed to display a set number pictures for displaying on a surface or hanging on a wall.

Therefore, individuals who desire creating and displaying many pictures either individually or in collages are left with few options. Corkboards, ribbon boards, magnetic boards, wires with clothespins, and tape are a few of the alternative options available. However, each of these share in their own set of limitations including restrictions in size, location and long-term preservation of the picture. Pictures printed on paper-based materials are susceptible to degradation over time if they are not properly secured and mounted. Pictures may curl from end to end or at the corners, holes may be punctured in them when mounted on corkboards and tape may peel off the backing or ink surface of a picture when the location or orientation is adjusted. All of these are undesirable and aesthetically unpleasant results.

Thus, there is a need for a picture mounting apparatus, system, and method that overcomes these and other disadvantages.

SUMMARY OF THE INVENTION

The disclosed invention relates to a picture mounting apparatus comprising: a frame member, the frame member comprising: a frame front surface; a frame rear surface located on a side opposite of the frame front surface; at least one connection area located on the frame member; a connector configured to removably attach to the at least one connection area, the connector comprising: a connector front surface; a connector rear surface on a side opposite of the connector front surface; a first tab located on the connector; a second tab located on the connector; a curved slit located between the first tab and the second tab; and where the connection area is configured to removably hold one corner of a photograph.

The disclosed invention also relates to a method of mounting a picture with a picture mounting apparatus comprising inserting a connector into a connection area of a frame member, fastening a second side of an adhesive to a mounting surface, and inserting a corner of a picture into the connection area of the frame member.

The disclosed invention further relates to a method of displaying a picture comprising attaching a picture mounting apparatus to a wall with an adhesive and inserting a picture into at least one connection areas of a frame member.

The disclosed invention additionally relates to a connector configured to selectively attach to at least one connection area comprising a connector front surface, a connector rear surface on a side opposite of the connector front surface, a first tab located on the connector, a curved slit located between the first tab and the second tab, and the connection area comprising an opening.

DETAILED DESCRIPTION OF EMBODIMENTS OF THE INVENTION

Figure 1:
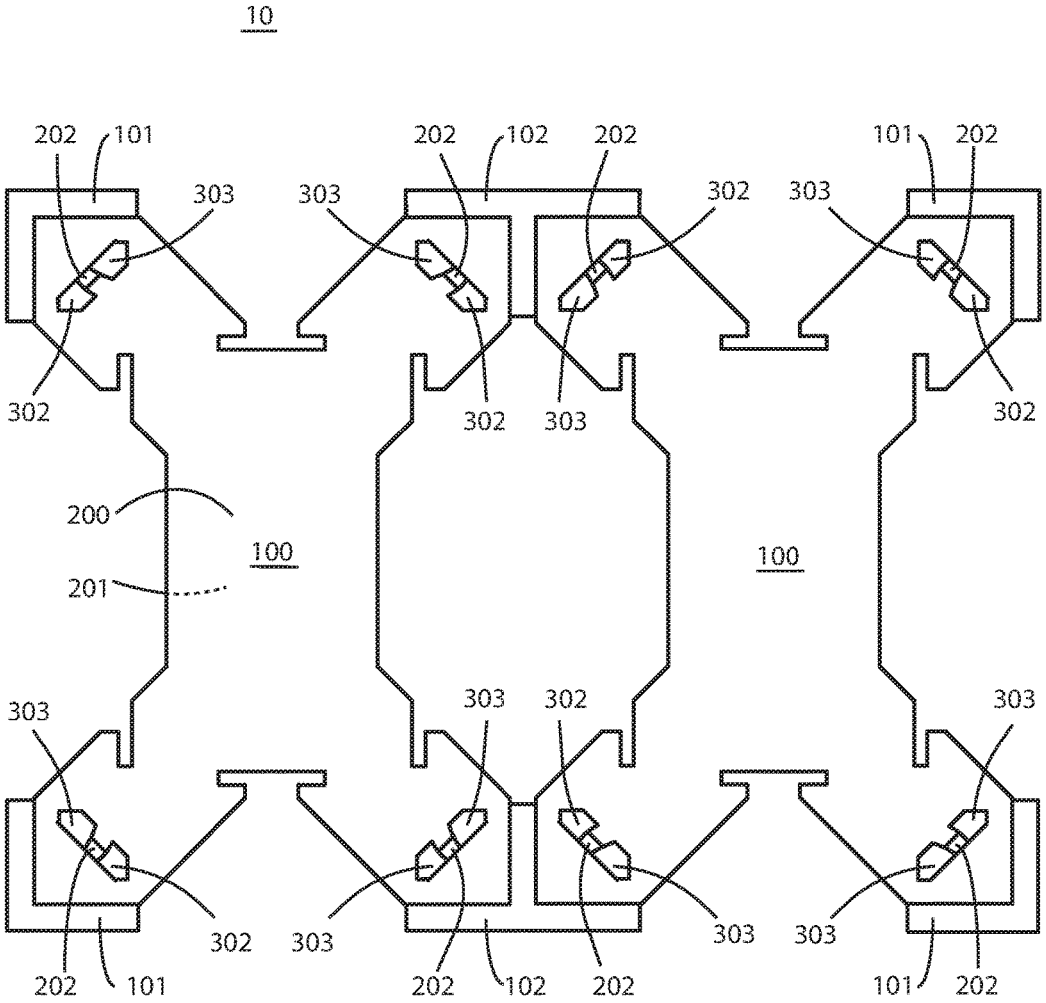
FIG. 1 depicts a top view of an exemplary assembly of a picture mounting apparatus.

The following description of particular embodiment(s) is merely exemplary in nature and is in no way intended to limit the scope of the invention, its application, or uses, which may, of course, vary. The invention is described with relation to the non-limiting definitions and terminology included herein. These definitions and terminology are not designed to function as a limitation on the scope or practice of the invention but are presented for illustrative and descriptive purposes only. While the processes or compositions are described as an order of individual steps or using specific materials, it is appreciated that steps or materials may be interchangeable such that the description of the invention may include multiple parts or steps arranged in many ways as is readily appreciated by one of skill in the art.

It will be understood that, although the terms "first," "second," "third" etc. may be used herein to describe various elements, components, regions, layers, and/or sections, these elements, components, regions, layers, and/or sections should not be limited by these terms. These terms are only used to distinguish one element, component, region, layer, or section from another element, component, region, layer, or section. Thus, a "first" element, component, region, layer, or section discussed below could be termed a "second" (or other) element, component, region, layer, or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. The term "or a combination thereof" means a combination including at least one of the foregoing elements.

Unless otherwise defined, all terms (including technical and scientific terms) used herein have the same meaning as commonly understood by one of ordinary skill in the art to which this disclosure belongs. It will be further understood that terms such as those defined in commonly used dictionaries, should be interpreted as having a meaning that is consistent with their meaning in the context of the relevant art and the present disclosure, and will not be interpreted in an idealized or overly formal sense unless expressly so defined herein.

A picture mounting apparatus, method of making and use thereof are provided. However, other items may be mounted using the disclosed apparatus. Items such as concert tickets, movie tickets, post cards, or any other suitable item may be mounted using the disclosed apparatus.

As illustrated in FIGS. 1-12, a picture mounting apparatus 10 comprises a frame member 100 and connector components 101, 102, 103, and 104. In an embodiment, the frame member 100 comprises a front surface 200, a rear surface 201, and a connection area 202. The connection area 202 may be a slot in some embodiments. The connector components 101, 102, 103, and 104 comprise a first surface 300, a second surface 301, a first tab 302, a second tab 303, and a curved slit 304. An embodiment comprises a frame member 100 connected through one of the connection areas 202 to at least one of the connector components 101, 102, 103, 104, a picture 600 attached to the frame member 100 through at least one of the connection areas 202 and adhesive 400 fastening the second surface 301 of one of the connector components 101, 102, 103, 104 to a mounting surface 500. The mounting surface 500 may be a wall, bulletin board, or any other suitable surface for placing a picture.

Referring now to FIG. 1, a top view of an exemplary assembly of a picture mounting apparatus 10 is depicted. In the shown embodiment, the picture mounting apparatus 10 comprises at least two frame members 100. In other embodiments the picture mounting apparatus may comprise one or more frame members 100 and two or more connector components 101, 102, 103, 104 attached to the frame member 100. The frame member 100 comprise of a sheet of material with a front surface 200 and a rear surface 201. The connector components 101, 102, 103 and 104 (shown in FIG. 3) comprise of a sheet of material with a first surface 300 and a second surface 301. The surfaces 200, 201, 300 and 301, are not limited to a flat or smooth surface. The surfaces 200, 201, 300 and 301, may comprise a wavy pattern or textured surface. The frame member 100 and connector components 101, 102, 103 and 104, as described below, may comprise a flexible material, optionally a cellulose based material. The frame member 100 and connectors 101, 102, 103 and 104 may optionally comprise a flexible plastic, acrylic or composite material. The frame member 100 and connector components 101, 102, 103 and 104 may comprise of different material or the same material.

The cellulose-based material may comprise a paper material, optionally card stock. The paper material may have a basis weight of about 50 lb. The basis weight is optionally between about 10 lbs. and about 105 lbs. The basis weight may optionally be about 16, 20, 24, 28, 40, 50, 60, 65, 70, 80, 90, 100, and 105 lbs. In one embodiment, the basis weight may range from about 24 lbs. to about 105 lbs. In other embodiments, the frame member 100 and connector components 101, 102, 103 and 104 may comprise of material with a thickness between about 0.0032 inches to about 0.0175 inches.

Figure 2:
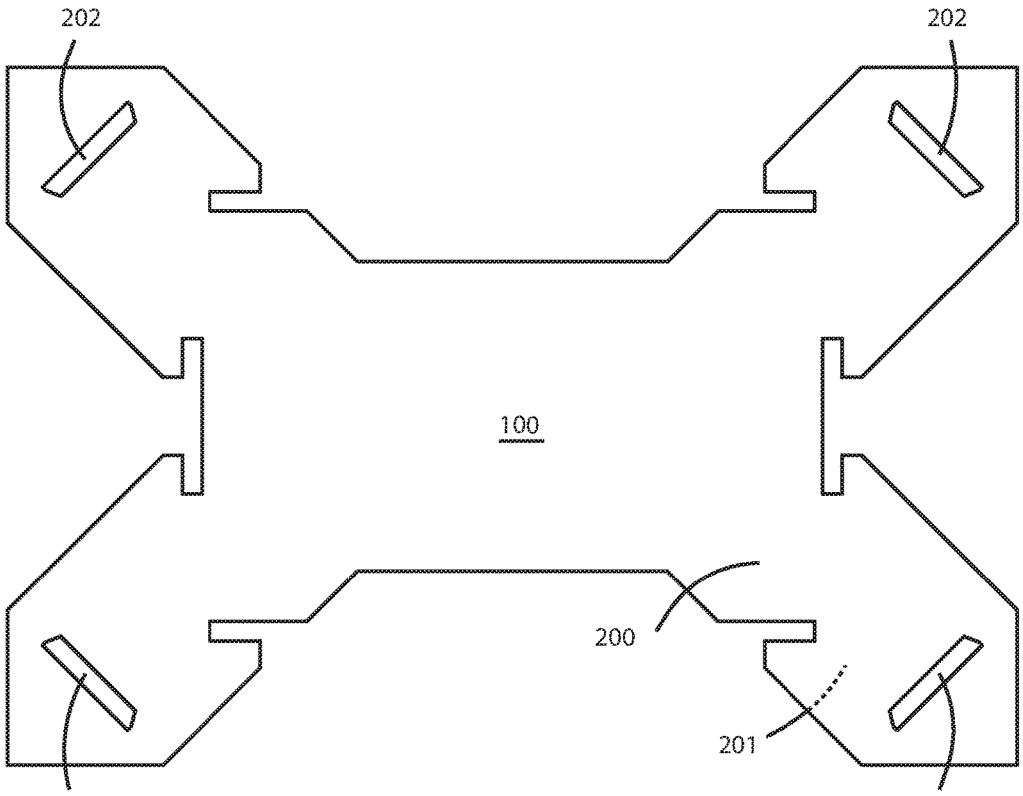
FIG. 2 depicts a top plane view of a generally rectangular exemplary frame member.

Referring now to FIG. 2, a top plane view of an exemplary frame member 100 is depicted. In an embodiment the frame member 100 comprises a rectangular shape with connection areas 202 offset from each corner and from the edges of the frame member 100 such that the plurality of connection areas 202 define a perimeter on the frame member 100. In one embodiment, the frame member 100 is about 6 inches long and about 4 inches wide. Of course, one of ordinary skill in the art will recognize this application will include frame members 100 of various dimensions. The connection areas 202 optionally comprise a slot.

In further embodiments, the connection areas may comprise a perforated open two-dimensional shape. The connection area, for example, may comprise a slit in the shape of a semi-circle. The connection area 202 may receive a male type connector portion 309 from a connector component 101, 102, 103, 104. The connection 202 area may also receive a corner of a picture, and hold the picture in place. The male type connector portion 309 may comprise any one or more tabs 302, 308, see FIG. 3 for example.

Figure 3:
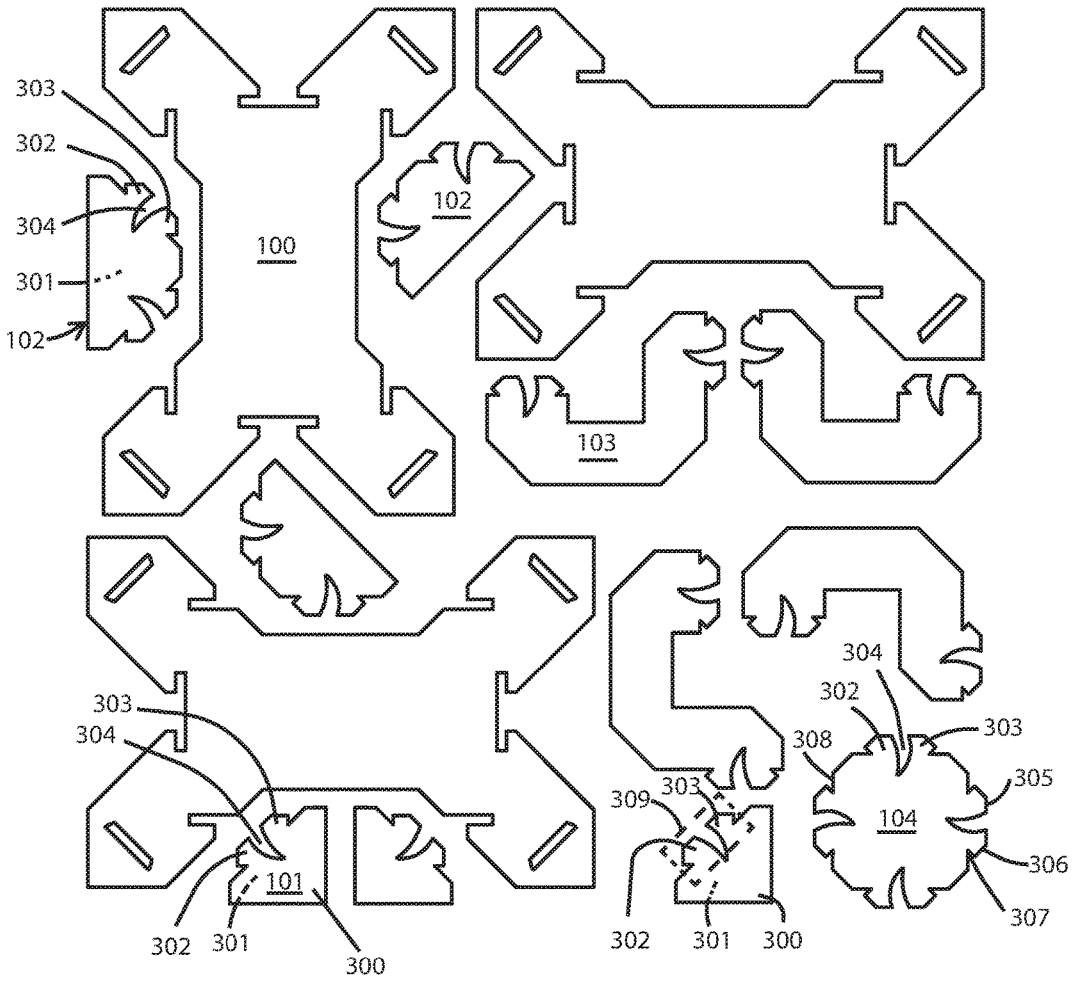
FIG. 3 depicts a top plane view of a die cut board defining frame member and connector components.

Referring now to FIG. 3, a top plan view of connector components 101, 102, 103, and 104 and a frame member 100 components is depicted. The connector components 101, 102, 103, and 104 and frame member 100 may be die cut. In particular, embodiments there may be at least four types of connector components 101, 102, 103 and 104. Each of the connector components 101, 102, 103 and 104 comprise a first tab 302, a second tab 303, and a curved slit 304. The combined shape of the first tab 302, second tab 303 and curved slit 304 form a male type connector 309. The male type connector 309 provides connection of the connector components 101, 102, 103, and 104 with the connection area 202 of the frame member 100.

In one embodiment the first tab 302 is inserted in the connection area 202 followed by inserting the second tab 303 where the curved slit 304 allows for compression of the space between the first tab 302 and second tab 303. The compression of the curved slit 304 facilitates the insertion of the second tab 303 such that a tapered edge 306 of the second tab 303 passes through the connection area 202. In a further embodiment, the second tab 303 may be inserted into the connection area 202 then the first tab 302 may be inserted. In yet another embodiment, the first tab 302 and the second tab 303 may be simultaneously inserted into the connection area 202. Once the tapered edge 306 of the first tab 302 and the second tab 303 pass through the connection area 202 an undercut 307 allows the space defined by the curved slit 304 to expand establishing an overlapping interference fit. The overlapping interference fit fastens the male type connector 309 to the connection area 202. The tapered edge 306 and undercut 307 are optionally formed such that the insertion force of the male type connector is less than the extraction force required to remove the male type connector 309 from the connection area 202.

In an embodiment, the first tab 302 is optionally larger than the second tab 303. In yet another embodiment the second tab 303 is optionally larger than the first tab 302. Optionally, the first tab 302 and the second tab 303 are equal in size. The first tab 302 and second tab 303 each comprise a leading edge 305, a tapered edge 306, an undercut 307, and a stop 308. In one embodiment the leading edge 305 optionally has a length of about 0.19 inches, the taper 306 optionally has a length of about 0.21 inches. In an embodiment, the curved slit 304 is disposed between the first tab 302 and the second tab 303. The stop 308 optionally has a length at least as long as the apex formed by the tapered edge 306 and the undercut 307. The stop 308 forms an edge inward of the leading edge 305 and preferably parallel to the leading edge 305. The stop 308 provides an edge preventing the male type connector 309 from passing through the connection area 202. The edge formed by the stop 308 is a counter edge to that of the undercut thereby creating an interlocking connection between the male type connector 309 and connection area 202.

Figure 4:
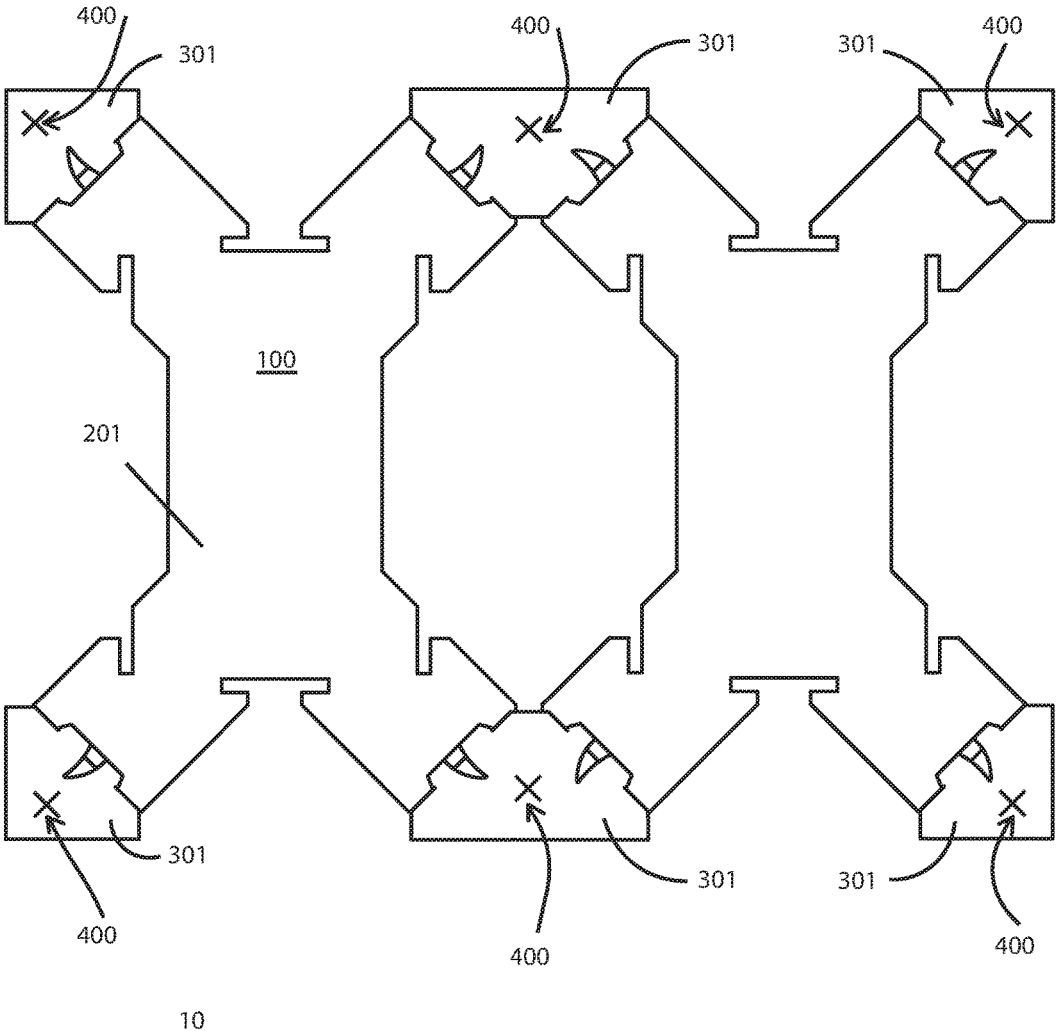
FIG. 4 depicts a back view of an exemplary assembly of two picture mounting apparatuses.
Figure 5:
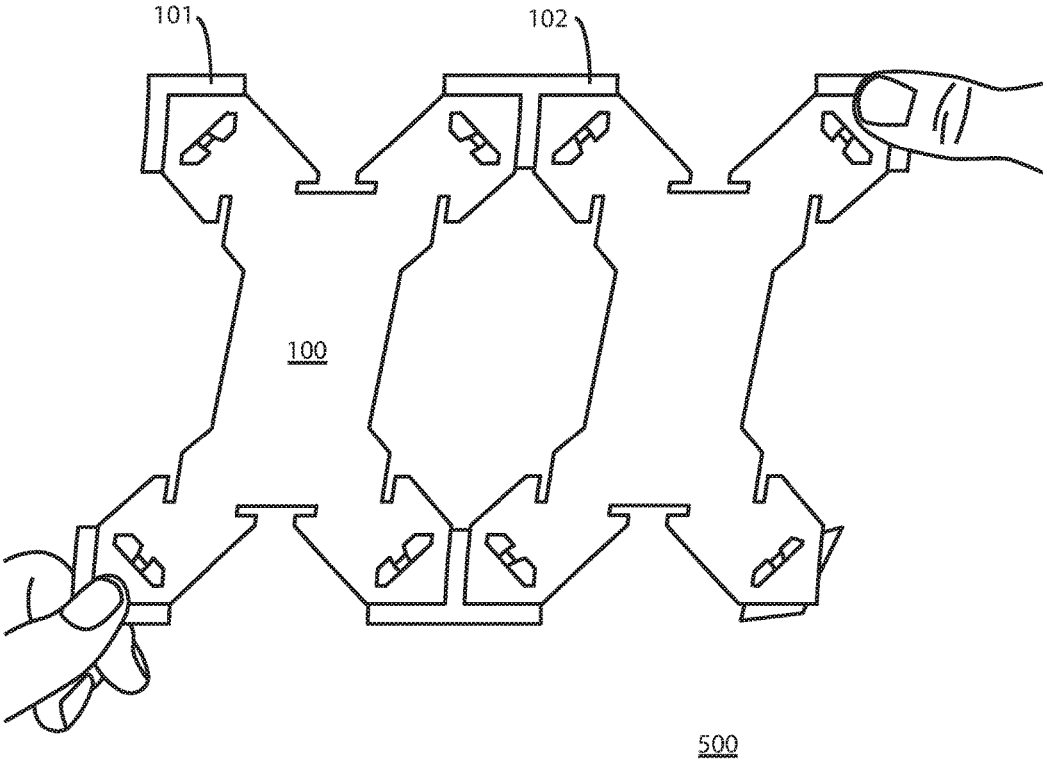
FIG. 5 depicts a step in mounting an exemplary assembly of two picture mounting apparatuses.

Referring now to FIG. 4, a back view of an exemplary assembly of a picture mounting apparatus 10 is depicted. In an embodiment adhesive 400 may be applied to the connector components 101, 102, 103, or 104 or frame member 100. The adhesive 400 may optionally be applied generally in the area identified with an "X." The adhesive 400 provides a mounting structure to the frame member 100 or connector components 101, 102, 103, or 104 and a mounting surface 500, such as a wall for example, as shown in FIG. 5. The adhesive may comprise two-sided tape such as Double-Sided Bonding Tape by 3M that is removable or permanent or any other variety of mounting adhesive know to those skilled in the art. The adhesive may also be a glue.

Figure 6:
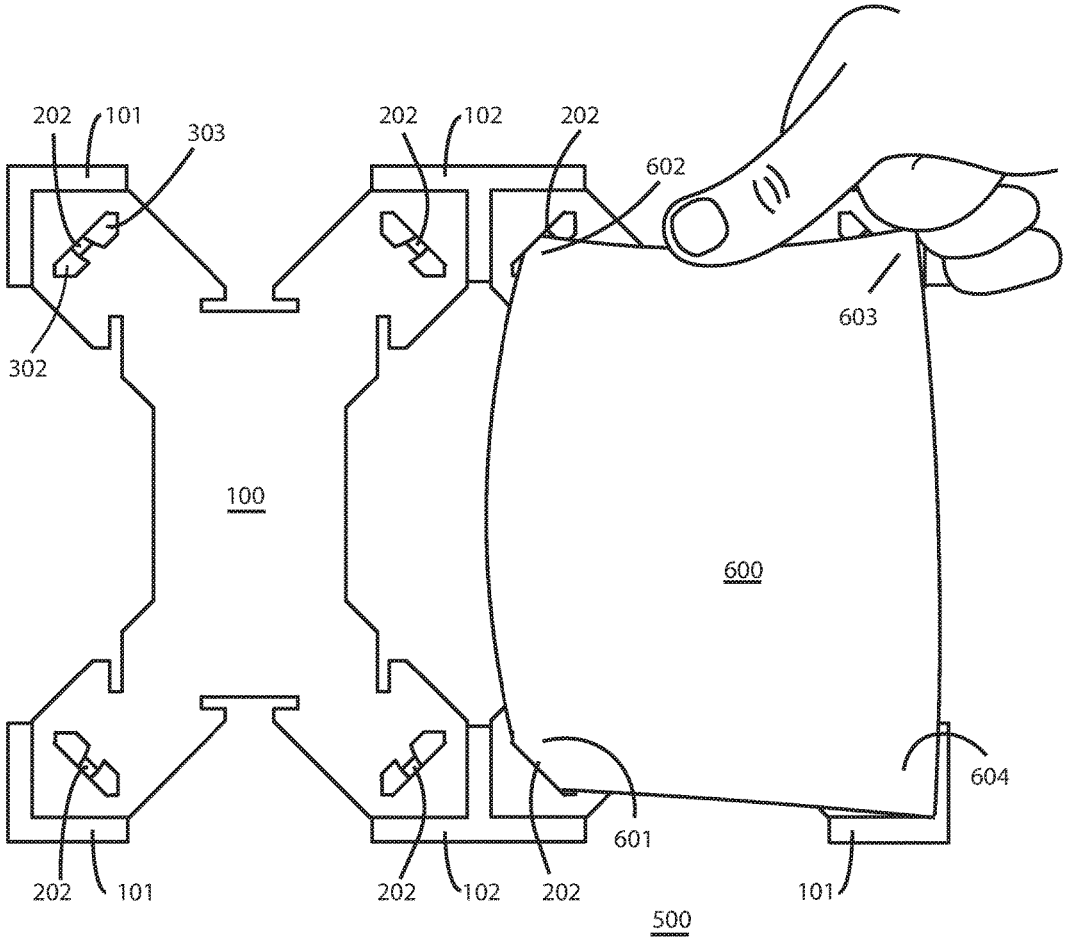
FIG. 6 depicts a step in installing a picture into an exemplary picture mounting apparatus.

Referring now to FIG. 6, an initial step of inserting a picture 600 into the frame member 100 is depicted. A typical picture 600 is in the shape of a rectangle and has four corners 601, 602, 603, and 604. It is conceivable that a picture may take on other shapes such as a square, a triangle, a circle or other two-dimensional closed geometric shape. In an embodiment where a picture 600 comprises four corners 601, 602, 603, and 604 each of the four corners 601, 602, 603, and 604 is inserted into the connection areas 202. Optionally, only one of the four corners 601, 602, 603, and 604 may be inserted into one of the connection areas 202. Additionally, only two of the four corners 601, 602, 603, and 604 may be inserted into the connection areas 202. Furthermore, only three of the four corners 601, 602, 603, and 604 may be inserted into the connection areas 202.

In further embodiments, a frame member 100 may be adapted to connect a picture of non-rectangular shape but having at least an edge where a picture 600 may be attached to the frame member 100. In similar embodiments, the connection areas 202 may comprise a slit. The slit type connection areas 202 may provide an additional functionality of mounting a picture without any corners such as a circle shape picture.

In some embodiments, a frame member 100 is mounted to a mounting surface 500 then a picture 600 is inserted. In other embodiments, a picture 600 may be inserted into a frame member 100 then mounted to a mounting surface 500. In yet further embodiments at least one of the connector components 101, 102, 103, and 104 is attached to a frame member and mounted to a mounting surface 500. The insertion of the picture 600 may be completed at any time during assembly and or mounting of the picture mounting apparatus.

Figure 7:
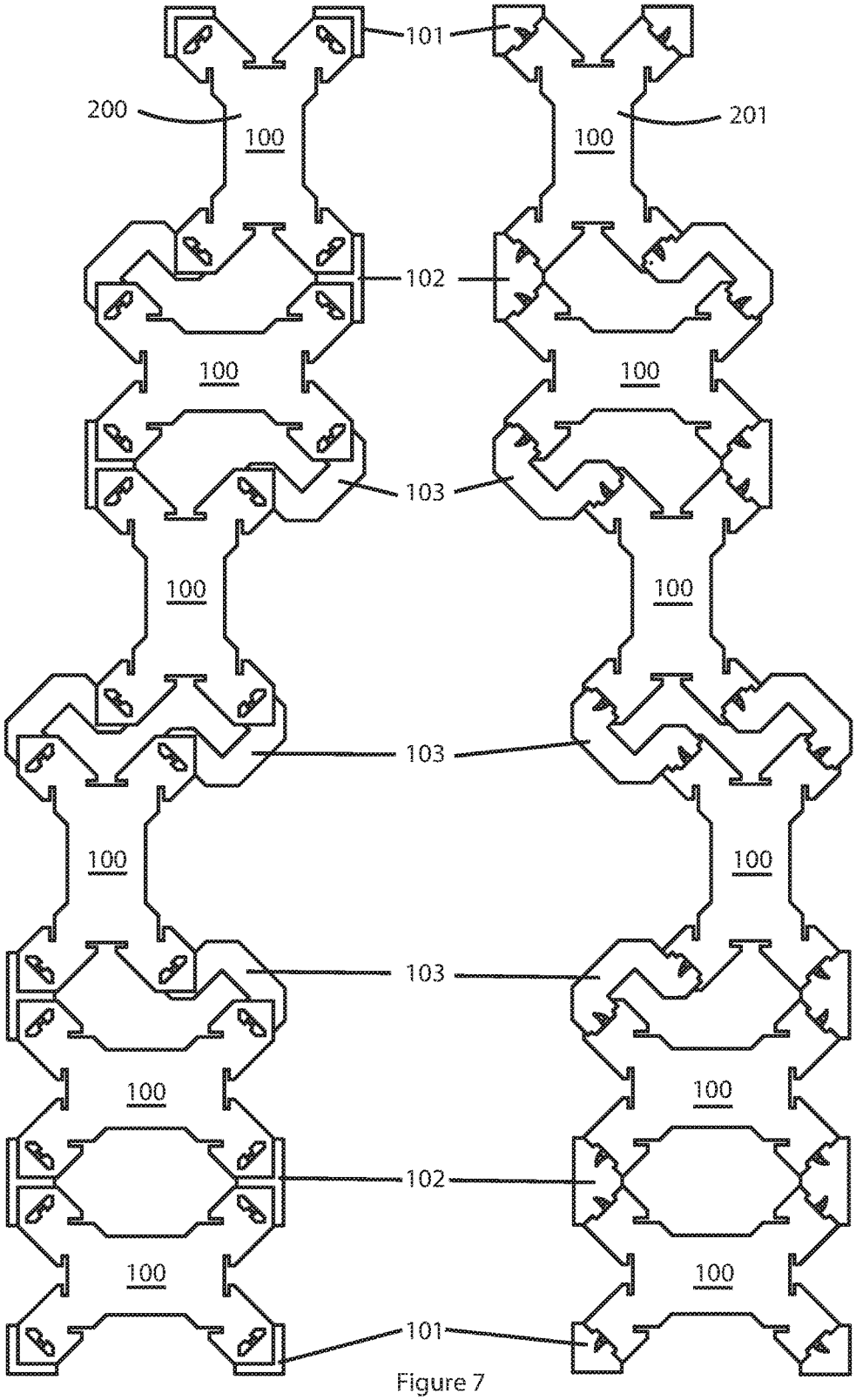
FIG. 7 depicts an exemplary assembly of multiple picture mounting apparatuses.

Referring to FIG. 7, an exemplary assembly of multiple picture mounting apparatuses is depicted. A variety of configurations of frame members 100 and connector components 101, 102, 103, and 104 as shown by exemplary configurations 701 and 702.

Figure 8:
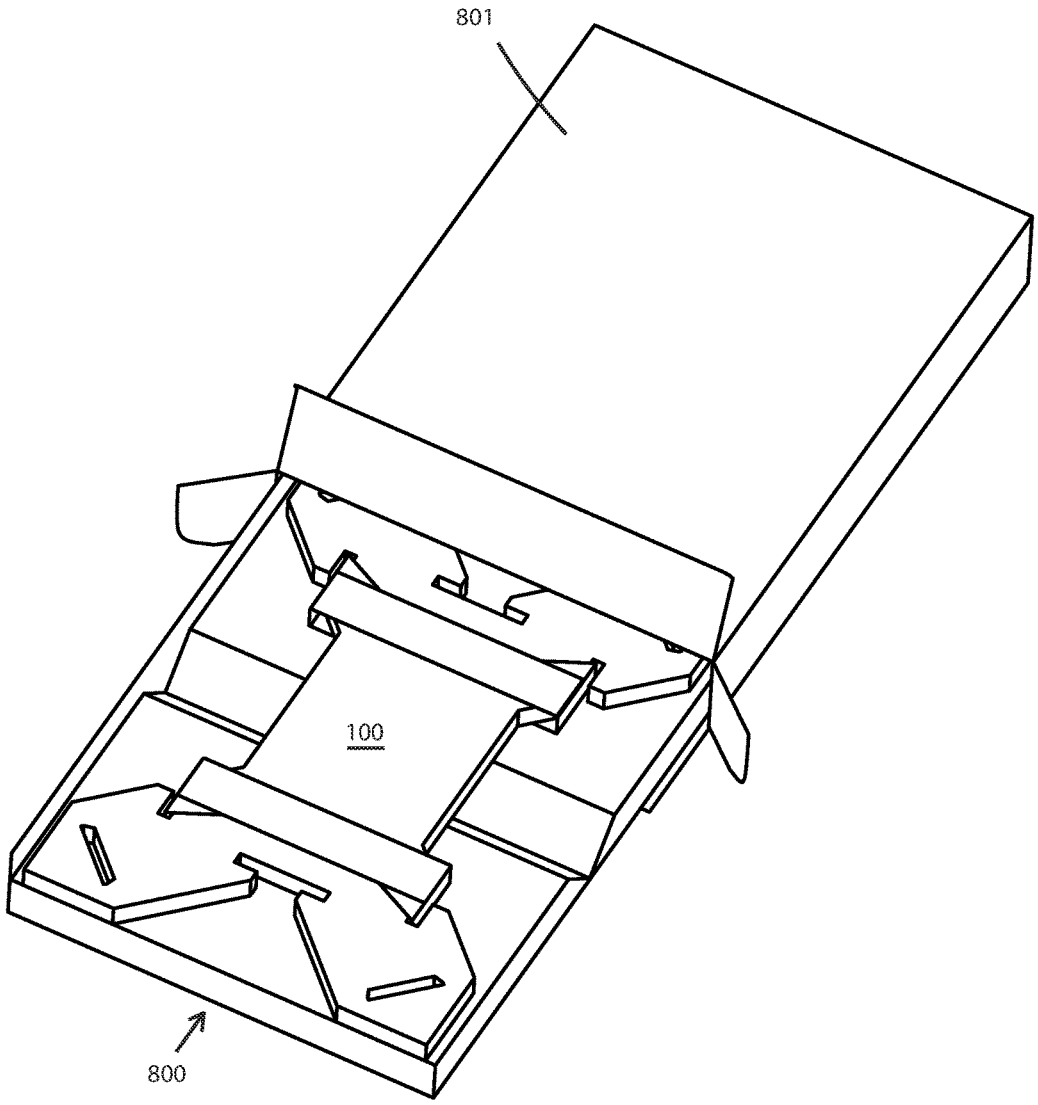
FIG. 8 depicts an exemplary packaging assembly for a picture mounting kit.

Referring to FIG. 8, an exemplary packaging assembly for a picture mounting kit is depicted. A picture mounting kit may include components hereinbefore described including at least a frame member 100, and connector components 101, 102, 103, 104. The embodied packaging assembly is an example of a packaging structure that may be used to contain and/or display components of the picture mounting kit for sale in the market place. The packaging assembly may include an insert 800 and an outer structure 801. The outer structure may compromise a variety of materials known in the art to contain products for sale. Some materials may include paper-based materials formed to a box-like shell capable of receiving an insert 800. Additionally, other materials may include plastics. The outer structure 801 should at least be sufficient to encase the insert 800.

Figure 9:
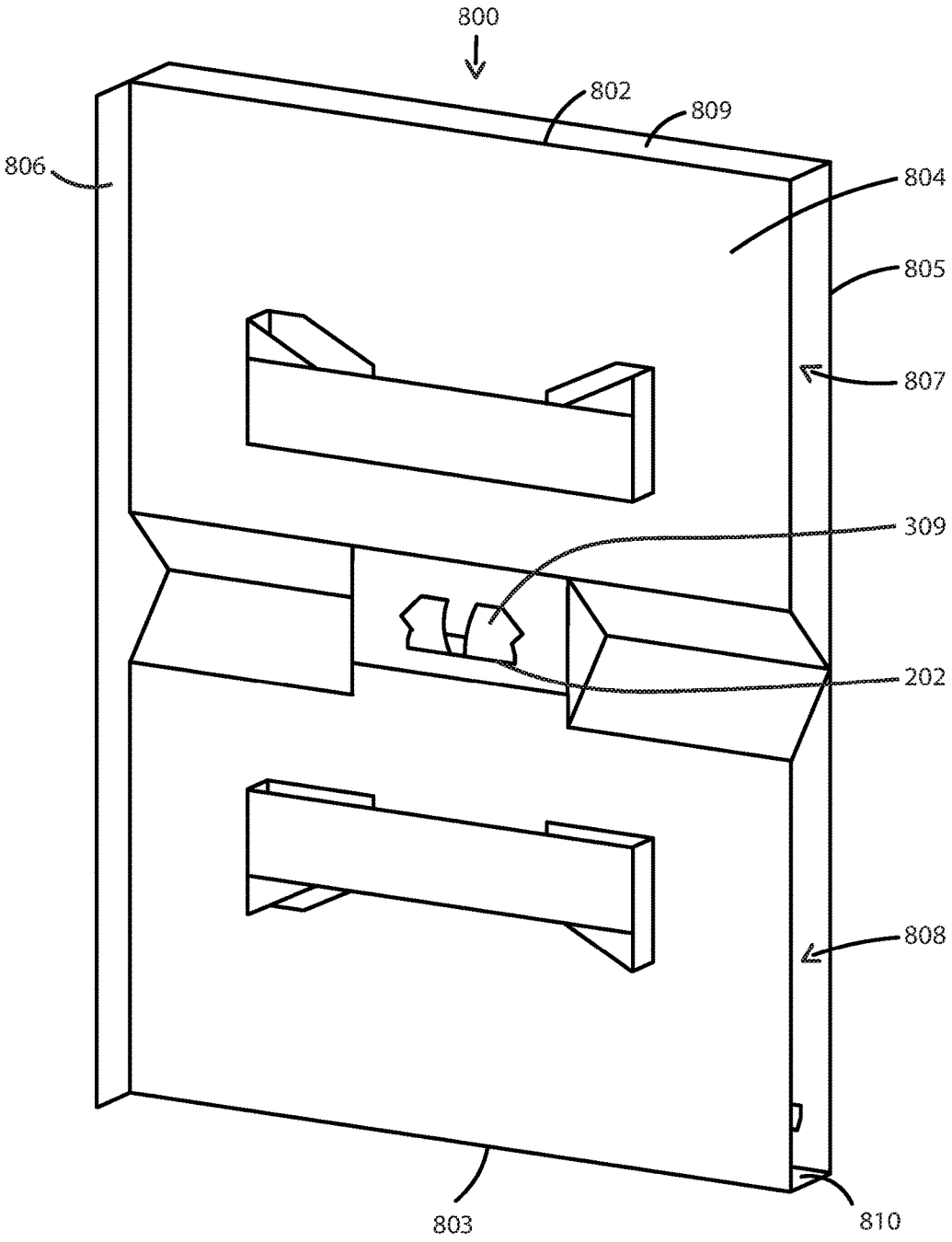
FIG. 9 depicts an exemplary insert for packaging a picture mounting kit.

Referring to FIG. 9, an exemplary insert for packaging a picture mounting kit is depicted. The insert 800 utilizes the unique connector 309 and connection areas 202, previously disclosed, to form the structure of the insert 800. In the embodiment depicted in FIG. 9, the insert 800 includes a connection area 202 receiving a connector 309 at about the midpoint between a first edge 802 and a second edge 803. Folding portions of the front surface 804 of the insert 800 adjacent to connection area 202 and connector 309 bring about the reception of the connector 309 into connection area 202. Folding portions of the front surface 804 away from the front surface 804 thereby toward a back surface 805 of the insert 800 may also create a support structure between the front 804 and back 805 surface of the insert 800.

Additionally, folding portions of the front surface 804 may create a first opening 807 and a second opening 808 enclosed between the front surface 804 and the back surface 805. The first opening 807 and the second opening 808 may optionally be utilized to receive components of the picture mounting kit for packaging and/or storage. A flange 806, formed by folding a portion of the back surface 805 that extends beyond the width of front surface 804, as exemplified in FIG. 10, may enclose one end of the first opening 807 and second opening 808. The first opening 807 and second opening 808 are further enclosed by a first surface 809 extending along the first edge 802 and a second surface 810 extending along the second edge 803.

Figure 10:
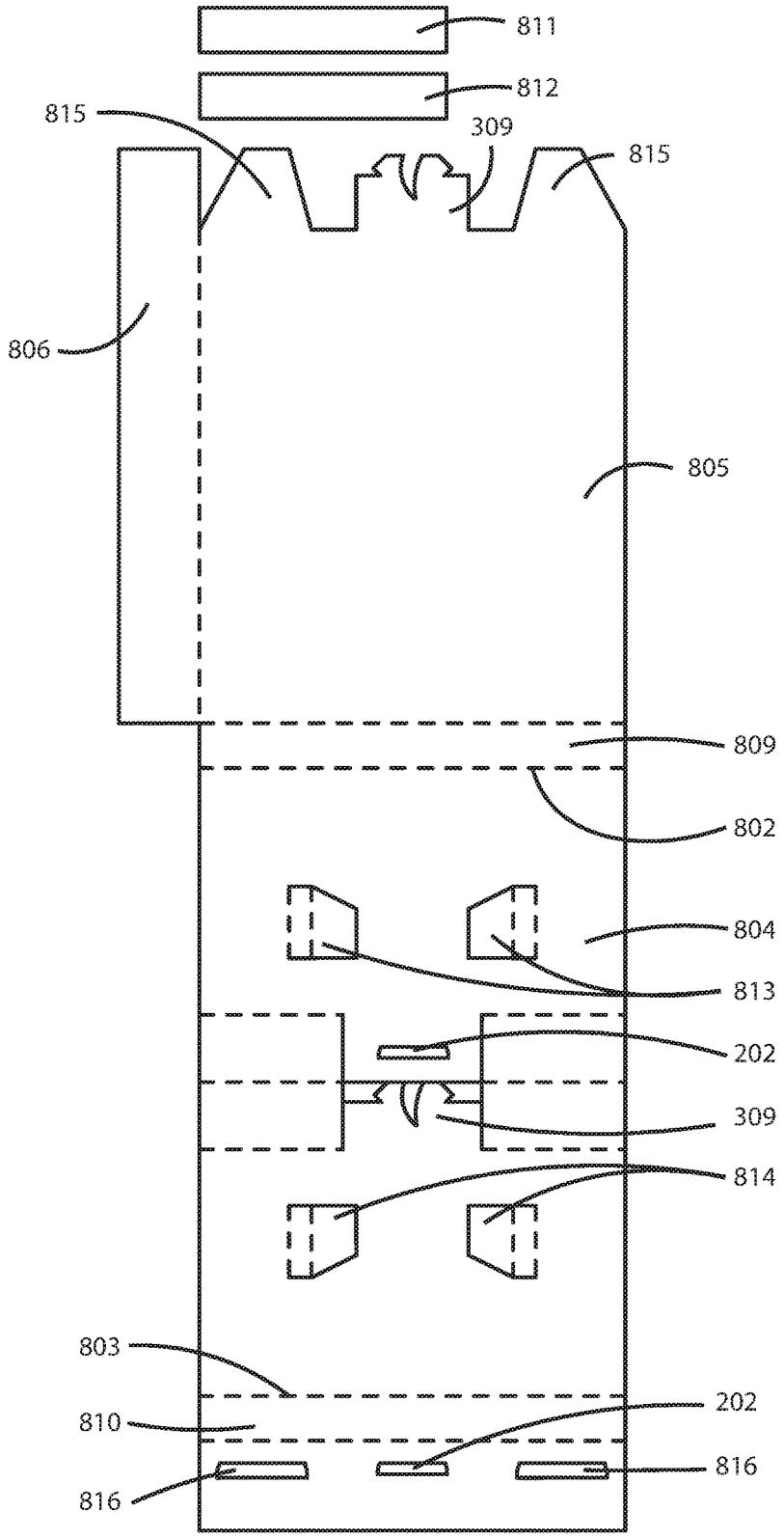
FIG. 10 depicts a top plane view of a die cut board defining an insert for packaging a picture mounting kit.

Referring to FIG. 10, an exemplary top plane view of a die cut board defining an insert for packaging a picture mounting kit is depicted. In this depiction, the solid lines define cuts and the dashed lines define fold locations. In this embodiment, the insert 800 may be formed from a single piece of material. Formation of the insert from a generally 2-dimensional die cut to a 3-dimensional structure is accomplished by folding the material and fastening at least two connectors 309 and connection areas 202. In this embodiment, adhesive may optionally be used to fasten a first retainer 811 and second retainer 812 to a first set of folded standoffs 813 and a second set of folded standoffs 814, respectively. The fastening of the first and second retainers 811, 812 to the first and second set of folded standoffs 813, 814 secure one or more frame members 100 to the insert 800.

Figure 11:
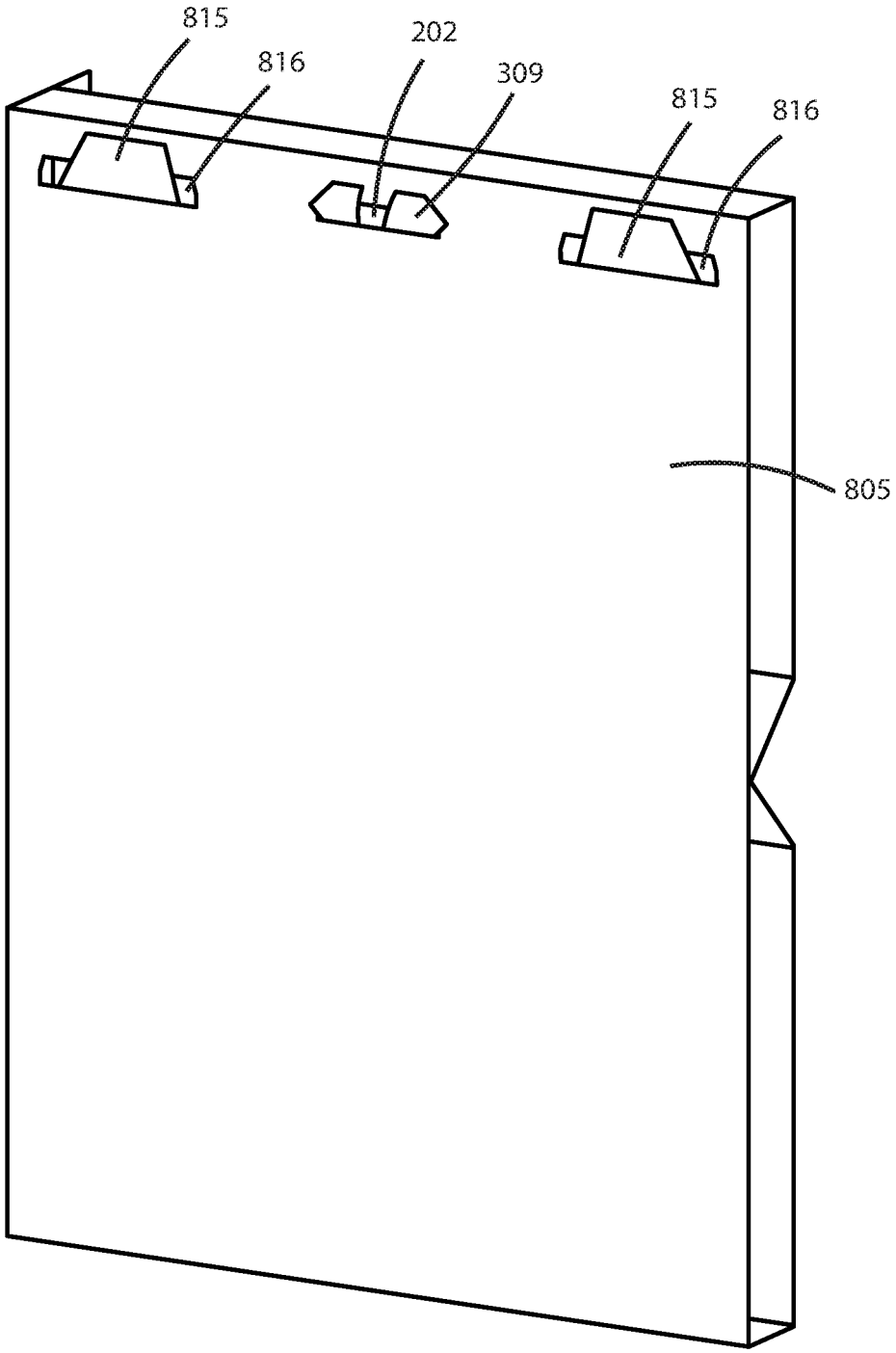
FIG. 11 depicts a rear view of an exemplary insert for packaging a picture mounting kit.

Referring to FIG. 11, a rear view of an exemplary insert is depicted. In the depicted embodiment, the back surface and the front surface join through the connection of a connector 309 and a connection area 202. Additionally, one or more tabs 815 and corresponding slots 816 adjacent to the connector 309 and connection area 202 may insert into each other to provide more overlap between the front surface 804 and back surface 805 The tabs 815 and corresponding slots 816 may also operate as locating features to aid assembly of the insert 800.

Figure 12:
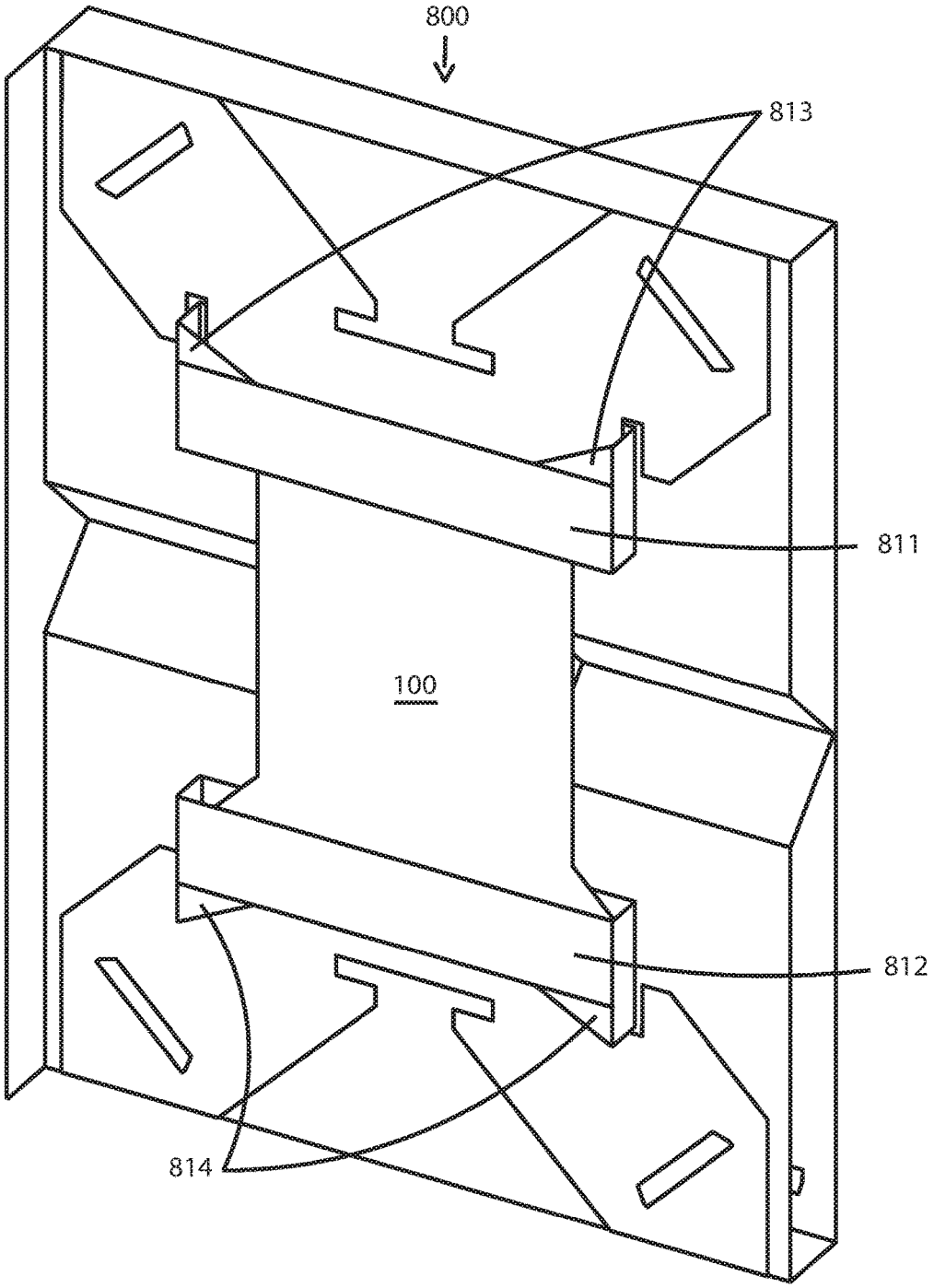
FIG. 12 depicts an exemplary insert for packaging a picture mounting kit including a frame member.

Referring to FIG. 12, an exemplary insert for packaging a picture mounting kit including a frame member is depicted. This embodiment is similar to the one depicted in FIG. 9, except FIG. 12 includes a frame member 100 secured to the insert 800. In such an embodiment, the insert 800 secures one or more frame members 100 to the insert 800 by locating the midsection of the frame member 100 within the first and second set of folded standoffs 813, 814 and then fixing the first and second retainers 811, 812 to the first and second set of folded standoffs 813, 814.

While the invention has been described with reference to an exemplary embodiment, it will be understood by those skilled in the art that various changes can be made and equivalents can be substituted for elements thereof without departing from the scope of the invention. In addition, many modifications can be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. The disclosed embodiments are illustrative, not restrictive.

We claim:

1. A picture mounting apparatus comprising:

a frame member, the frame member comprising:

a frame front surface;

a frame rear surface located on a side opposite of the frame front surface;

at least one connection area located on the frame member; and a connector configured to removably attach to the at least one connection area, the connector comprising:

a connector front surface;

a connector rear surface on a side opposite of the connector front surface;

a first tab located on the connector and in the same plane as the connector;

a second tab located on the connector and in the same plane as the connector;

a curved slit having an opening along the perimeter, located between the first tab and the second tab;

wherein the connection area is configured to removably hold one corner of a photograph.

2. The picture mounting apparatus of claim 1, further comprising:

a connector component having one or more connectors situated about an edge of the connector component.

3. The picture mounting apparatus of claim 1, further comprising:

a two-sided adhesive material comprising a first side adhered to the rear surface of a connector and a second side configured to adhere to a mounting surface.

4. The picture mounting apparatus of claim 1, wherein the connector couples to a connection area of at least one frame member.

5. The picture mounting apparatus of claim 1, further comprising a picture having at least one corner insertably mounted into at least one connection area of a frame member.

6. The picture mounting apparatus of claim 1, wherein the two-sided adhesive material couples a frame member to a mounting surface.

7. The picture mounting apparatus of claim 1, wherein more than one frame member is coupled together with one or more connectors insertably attached to at least one connection area.

8. A method of displaying a picture, the method comprising:

attaching a picture mounting apparatus of claim 1 to a wall with an adhesive; and inserting a picture into at least one connection area of a frame member.

9. A method of mounting a picture with a picture mounting apparatus comprising:

inserting a connector into a connection area of a frame member;

fastening a connector into a connection area of a frame member; and inserting a corner of a picture into the connection area of the frame member wherein the connector comprises:

a connector front surface;

a connector rear surface on a side opposite of the connector front surface;

a first tab located on the connector and in the same plane as the connector;

a second tab located on the connector and in the same plane as the connector; and a curved slit having an opening along the perimeter, located between the first tab and the second tab.

* * * * *